US008508317B2

(12) United States Patent
Wu

(10) Patent No.: US 8,508,317 B2
(45) Date of Patent: Aug. 13, 2013

(54) BROADBAND COUPLING FILTER

(75) Inventor: Min-Chung Wu, Taoyuan County (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 413 days.

(21) Appl. No.: 12/911,738

(22) Filed: Oct. 26, 2010

(65) Prior Publication Data

US 2011/0215885 A1 Sep. 8, 2011

(30) Foreign Application Priority Data

Mar. 5, 2010 (TW) ..... 99106459 A

(51) Int. Cl.
*H01P 1/203* (2006.01)

(52) U.S. Cl.
USPC ..... 333/204; 333/116

(58) Field of Classification Search
USPC ..... 333/204, 205, 219, 235, 115, 116
See application file for complete search history.

(56) References Cited

U.S. PATENT DOCUMENTS

| | | | | |
|---|---|---|---|---|
| 4,644,302 | A | 2/1987 | Harris | |
| 5,634,208 | A | 5/1997 | Nishikawa | |
| 6,906,373 | B2 | 6/2005 | Lee | |
| 7,319,850 | B2 * | 1/2008 | Motoyama | 455/307 |
| 7,324,060 | B2 | 1/2008 | Quan | |
| 2007/0046393 | A1 | 3/2007 | Quan | |
| 2009/0273413 | A1 | 11/2009 | Zhang | |
| 2010/0210208 | A1 | 8/2010 | Gorbachov | |
| 2010/0321131 | A1 | 12/2010 | Tsai | |
| 2011/0025434 | A1 * | 2/2011 | Hsieh et al. | 333/204 |
| 2011/0032049 | A1 | 2/2011 | Tahara | |

OTHER PUBLICATIONS

Wu, Title of Invention: Power Divider and Dual-output Radio Transmitter, U.S. Appl. No. 12/634,692, filed Dec. 10, 2009.

"New slot-coupled directional couplers between double-sided substrate microstrip lines, and their applications", Microwave Symposium Digest, 1988, Tanaka et al., IEEE MTT-S International Publication Year: 1988, pp. 579-582 vol. 2.

"Backward directional coupler for weak coupling of double-sided microstrip lines using longitudinal double-slots", Electronics Letters, Volume:40, Issue:5, Publication Year:2004, pp. 309-310, Mar. 4, 2004.

* cited by examiner

*Primary Examiner* — Benny Lee
*Assistant Examiner* — Gerald Stevens
(74) *Attorney, Agent, or Firm* — Winston Hsu; Scott Margo

(57) ABSTRACT

A broadband coupling filter for generating a notch filtering effect is disclosed. In the broadband coupling filter, a substrate includes a first layer, a second layer and a third layer. A first signal terminal, a second signal terminal, and a block transmission line are formed in the first layer, wherein the first signal terminal is used for receiving a signal, and the second signal terminal is used for outputting a filtering result of the signal. A grounding plate is formed in the second layer, having a hole. A third signal terminal, a forth signal terminal and a second block transmission line are formed in the third layer. A connection unit is further formed in the third layer, for connecting the third signal terminal and the forth signal terminal.

12 Claims, 6 Drawing Sheets

BROADBAND COUPLING FILTER

BACKGROUND OF THE INVENTION

1. Field of the Invention

The present invention relates to a broadband coupling filter, and more particularly, to a broadband coupling filter capable of generating a notch filtering effect.

2. Description of the Prior Art

A filter is an electronic element widely used for allowing signals within a specific frequency band, while attenuating or rejecting signals outside the frequency band. In general, a filter is composed of passive elements, such as resistors, capacitors and inductors, and thus an operating frequency band of a filter is unlikely to be extended, which causes disadvantages in broadband applications.

SUMMARY OF THE INVENTION

It is therefore an objective of the present invention to provide a broadband coupling filter.

The present invention discloses a broadband coupling filter. The broadband coupling filter includes a substrate, comprising a first layer, a second layer and a third layer, wherein the second layer is between the first layer and the third layer, a first signal terminal, formed in the first layer of the substrate, a second signal terminal, formed in the first layer of the substrate, a third signal terminal, formed in the third layer of the substrate, a fourth signal terminal, formed in the third layer of the substrate, a grounding plate, formed in the second layer of the substrate, and having a hole, a first block transmission line, formed at a position corresponding to the hole in the first layer of the substrate, and coupled to the first signal terminal and the second signal terminal, a second block transmission line, formed at a position corresponding to the hole in the third layer of the substrate, and coupled to the third signal terminal and the fourth signal terminal, and having a shape identical to a shape of the first block transmission line, and a connection unit, formed in the third layer of the substrate, for connecting the third signal terminal and the fourth signal terminal. The first signal terminal is utilized for receiving a signal, and the second signal terminal is utilized for outputting a filtering result of the signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
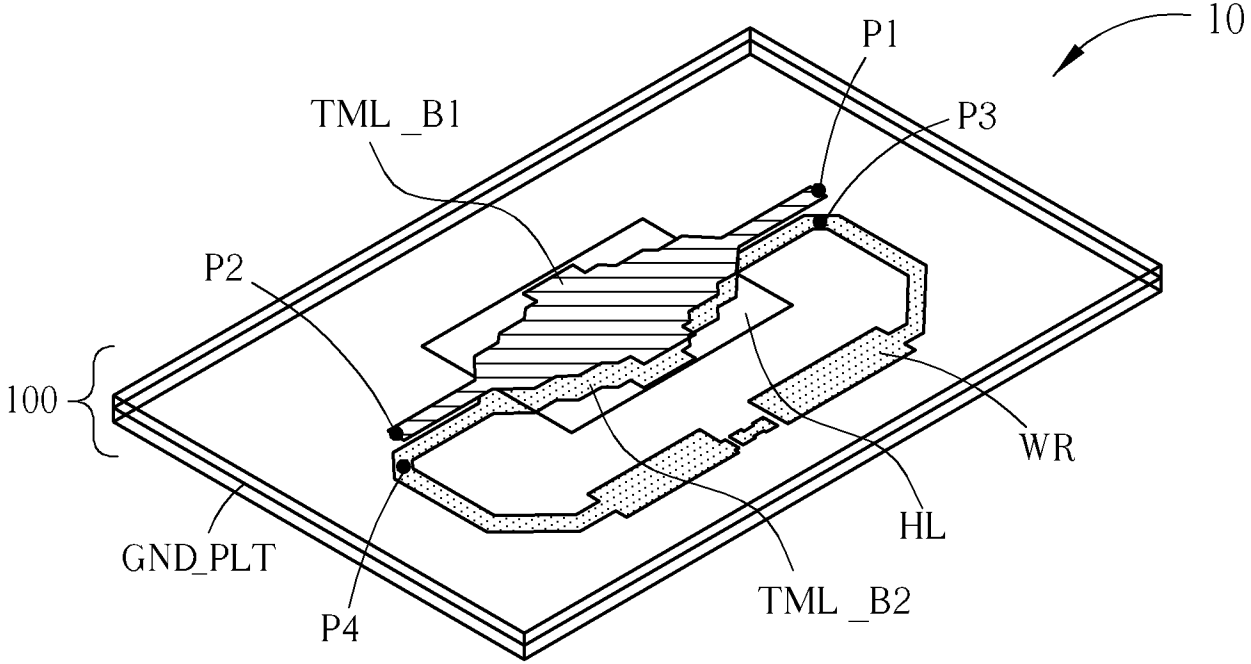
FIG. 1A is a schematic diagram of a broadband coupling filter according to an embodiment of the present invention
Figure 1B:
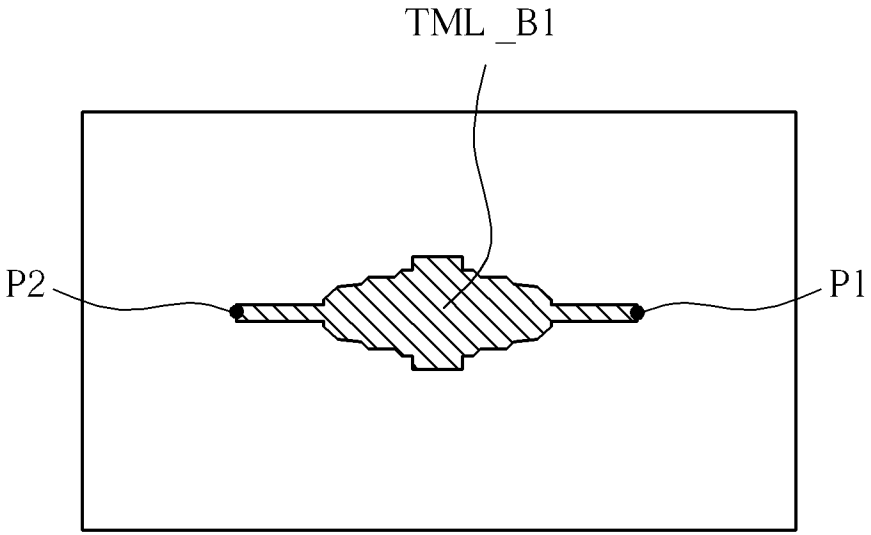
FIG. 1B to FIG. 1D are schematic diagrams of each layer of the broadband coupling filter in FIG. 1A.
Figure 1C:
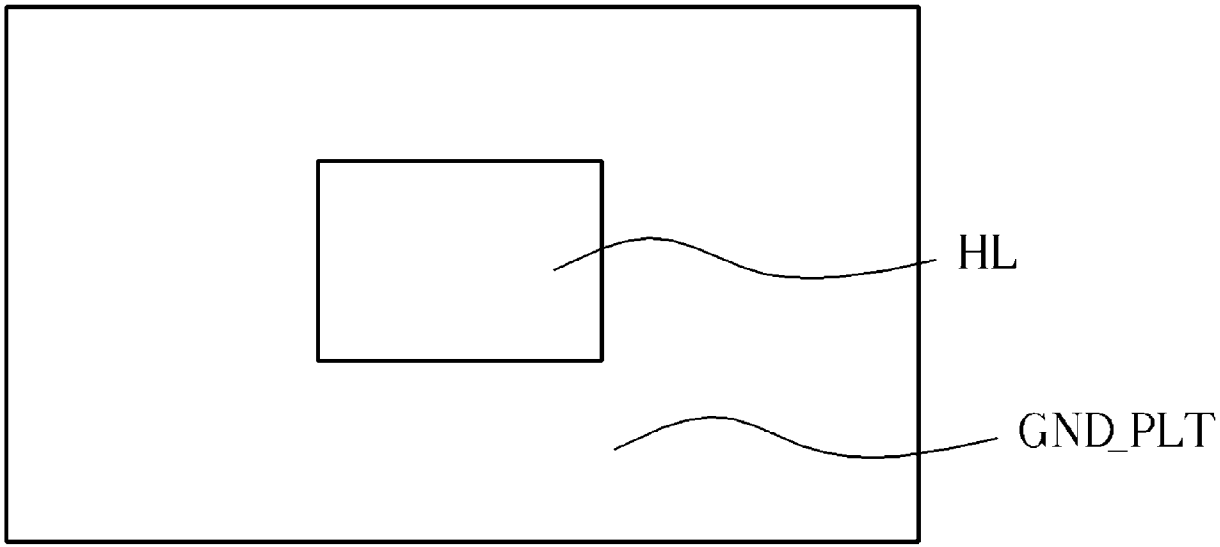
Figure 1D:
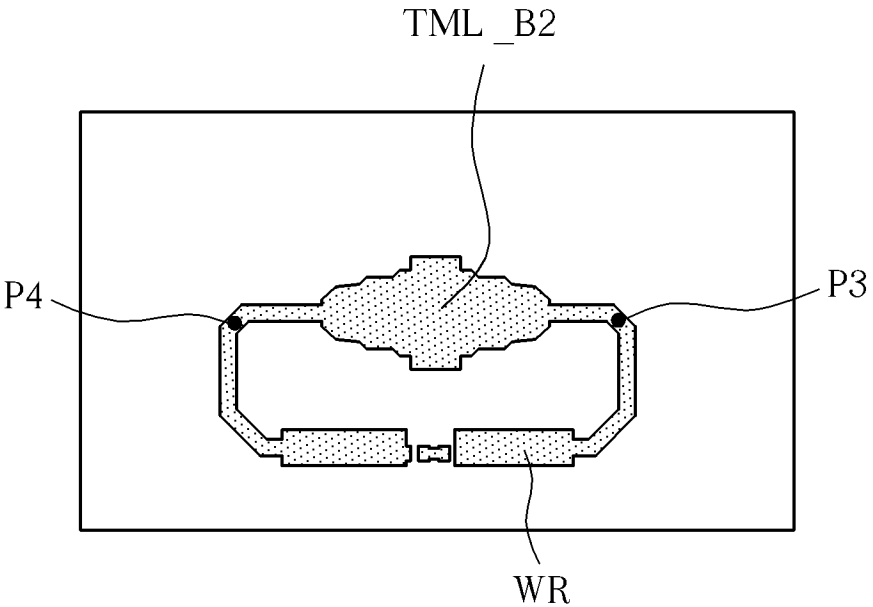

Please refer to FIG. 1A to FIG. 1D. FIG. 1A is a schematic diagram of a broadband coupling filter 10 according to an embodiment of the present invention, and FIG. 1B to FIG. 1D are schematic diagrams of each layer of the broadband coupling filter 10. The broadband coupling filter 10 uses partial structure of a power divider disclosed in U.S. patent application Ser. No. 12/634,692 (now U.S. Pat. No. 8,068,796, issued Nov. 29, 2011), and generates new effects. Therefore, the broadband coupling filter 10 can act as a feeding network of a smart antenna with little insertion loss, and can effectively suppress noises. In detail, the broadband coupling filter 10 includes a substrate 100, signal terminals P1, P2, P3, P4, a grounding plate GND_PLT, block transmission lines TML_B1, TML_B2 and a connection unit WR. The substrate 100 is a three-layer Printed Circuit Board (PCB), in which an upper layer (shown in FIG. 1B) includes the signal terminals P1, P2 and the block transmission line TML_B1 being printed, a middle layer (shown in FIG. 1C) includes the grounding plate GND_PLT being printed, and a lower layer (shown in FIG. 1C) includes the signal terminals P3, P4 and the block transmission line TML_B2 being printed. Furthermore, as can be seen from FIG. 1A to FIG. 1D, the grounding plate GND_PLT has a hole HL. The block transmission lines TML_B1 and TML_B2 have identical shapes, and are set above and below the hole HL respectively. Besides, the signal terminal P1 is utilized for receiving a signal, the signal terminal P2 is utilized for outputting a filtering result of the signal. The signal terminal P3 and the signal terminal P4 are connected via the connection unit WR.

Since the block transmission lines TML_B1 and TML_B2 are not isolated by the grounding plate GND_PLT, signals are coupled between the block transmission lines TML_B1 and TML_B2. After the connection unit WR connects the signal terminals P3 and P4, there is a loading effect in a transmission path from the signal terminal P1 to the signal terminal P2. Therefore, by properly adjusting a length, material, or components of the connection unit WR, different effects can be generated in the transmission path from the signal terminal P1 to the signal terminal P2.

Figure 2:
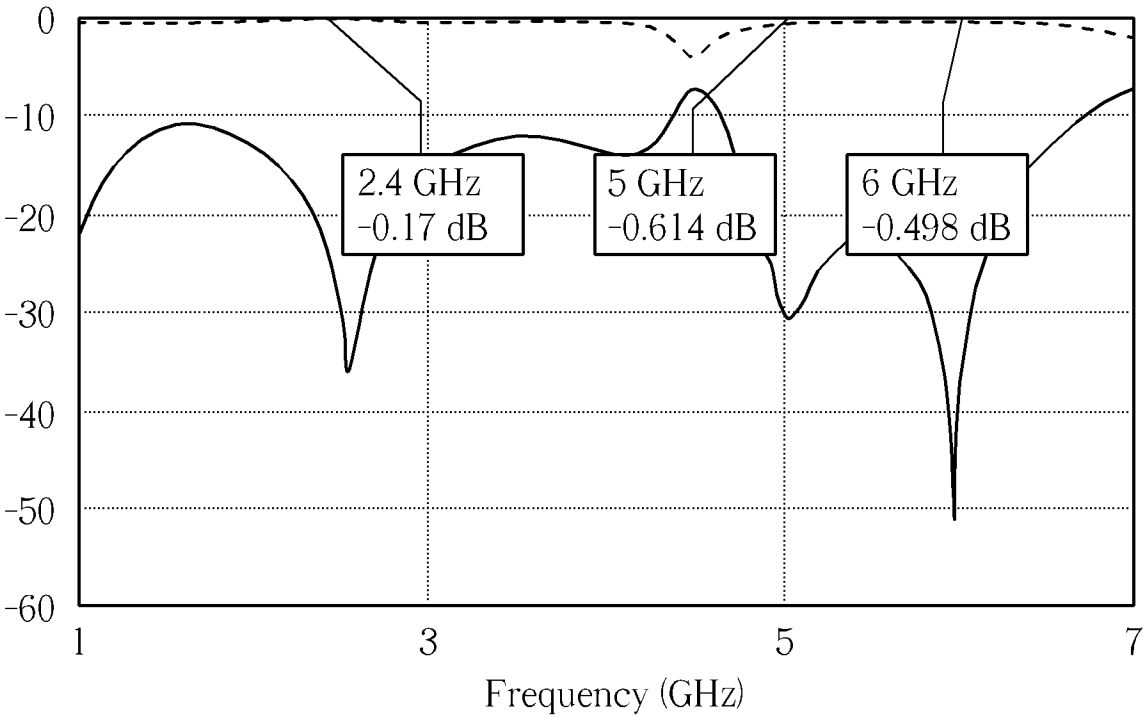
FIG. 2 and FIG. 3 are schematic diagrams of frequency responses of the broadband coupling filter in FIG. 1A.

For example, if the connection unit WR is realized by a metal conducting wire, a frequency response of the broadband coupling filter 10 can be represented by FIG. 2. In FIG. 2, a solid curve indicates ratios of energy transmitted and reflected to the signal terminal P1 indifferent frequencies, and a dot curve indicates ratios of energy transmitted (coupled) from the signal terminal P1 to the signal terminal P2 in different frequencies. As can be seen from FIG. 2, an insertion loss from the signal terminal P1 to the signal terminal P2 is very small.

Figure 3:
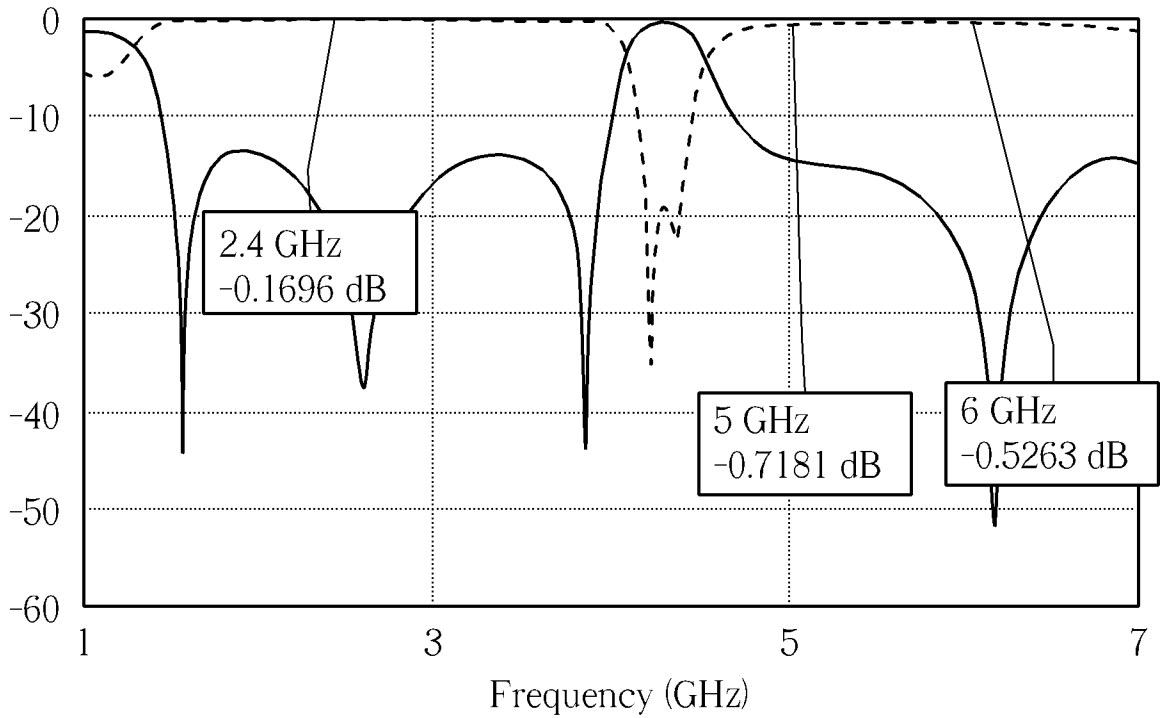

Furthermore, if the connection unit WR includes a capacitor and an inductor connected in series, a frequency response of the broadband coupling filter 10 can be generated as FIG. 3. Similarly, in FIG. 3, a solid curve indicates ratios of energy transmitted and reflected to the signal terminal P1 in different frequencies, and a dot curve indicates ratios of energy transmitted (coupled) from the signal terminal P1 to the signal terminal P2 in different frequencies. When the connection unit WR includes the capacitor and the inductor connected in series, the generated loading effect is similar to a resonating mode of a capacitor and an inductor connected in series to ground, or a capacitor and an inductor in parallel with the transmission path. In such a situation, the transmission path from the signal terminal P1 to the signal terminal P2 can generate a phenomenon of grounding short or open, i.e. a zero point, in specific frequencies, such that the frequency response is similar to that of a filter, so as to filter out noises in the transmission path.

As shown in FIG. 3, the broadband coupling filter 10 has a −20 dB cut-off effect between 4.1 GHz and 4.3 GHz, and small insertion loss in other frequency bands. This kind of notch filtering characteristics is especially suitable for a feeding network of a smart antenna. Noticeably, the frequency response shown in FIG. 3 is merely an exemplary embodiment, and a designer should properly modify a length, material of the connection unit WR or properly modify capacitance of the capacitor, inductance of the inductor according to system requirements, to determine a resonant frequency. In general, the longer the connecting wire is, the lower the resonant frequency is.

Except for adjusting a structure of the connection unit WR, the designer can modify shapes of the block transmission lines TML_B1, TML_B2 and the hole of the grounding plate GND_PLT according to system requirements as well, to generate a proper resonant frequency. Alterations about the shapes can be referred to U.S. patent application Ser. No. 12/634,692, and are not narrated hereinafter.

To sum up, the present invention utilizes a partial of the power splitter disclosed in U.S. patent application Ser. No. 12/634,692, and adds a connection unit, to generate a notch filtering effect, which is especially suitable for a feeding network of a smart antenna.

Those skilled in the art will readily observe that numerous modifications and alterations of the device and method may be made while retaining the teachings of the invention.

What is claimed is:

1. A broadband coupling filter, comprising:

a substrate, comprising a first layer, a second layer and a third layer, wherein the second layer is between the first layer and the third layer;

a first signal terminal, formed in the first layer of the substrate;

a second signal terminal, formed in the first layer of the substrate;

a third signal terminal, formed in the third layer of the substrate;

a fourth signal terminal, formed in the third layer of the substrate;

a grounding plate, formed in the second layer of the substrate, and having a hole;

a first block transmission line, formed at a position corresponding to the hole in the first layer of the substrate, and coupled to the first signal terminal and the second signal terminal;

a second block transmission line, formed at a position corresponding to the hole in the third layer of the substrate, and directly coupled to the third signal terminal and the fourth signal terminal, and having a shape identical to a shape of the first block transmission line; and a connection unit, formed in the third layer of the substrate, for connecting the third signal terminal and the fourth signal terminal;

wherein the first signal terminal is utilized for receiving a signal, and the second signal terminal is utilized for outputting a filtering result of the signal.

2. The broadband coupling filter of claim 1, wherein an area of the hole formed in the second layer of the substrate is greater than an area of the first block transmission line formed in the first layer of the substrate.

3. The broadband coupling filter of claim 1, wherein a width of an area of the first block transmission line formed in the first layer of the substrate changes from narrow to wide and to narrow.

4. The broadband coupling filter of claim 1, wherein the connection unit is related to a resonant frequency from the first signal terminal to the second signal terminal.

5. The broadband coupling filter of claim 1, wherein the connection unit is a conducting wire.

6. The broadband coupling filter of claim 1, wherein the connection unit comprises a capacitor and an inductor connected in series.

7. The broadband coupling filter of claim 1, wherein the connection unit and the second block transmission line are connected to the third signal terminal and the fourth signal terminal in parallel.

8. A broadband coupling filter, comprising:

a substrate, comprising a first layer, a second layer and a third layer, wherein the second layer is between the first layer and the third layer;

a first signal terminal, formed in the first layer of the substrate;

a second signal terminal, formed in the first layer of the substrate;

a third signal terminal, formed in the third layer of the substrate;

a fourth signal terminal, formed in the third layer of the substrate;

a grounding plate, formed in the second layer of the substrate, and having a hole;

a first block transmission line, formed at a position corresponding to the hole in the first layer of the substrate, and coupled to the first signal terminal and the second signal terminal to form a transmission path between the first signal terminal and the second signal terminal;

a second block transmission line, formed at a position corresponding to the hole in the third layer of the substrate, and coupled to the third signal terminal and the fourth signal terminal, and having a shape identical to a shape of the first block transmission line; and a connection unit, formed in the third layer of the substrate, for connecting the third signal terminal and the fourth signal terminal along a path different from that formed by the second block transmission line, to adjust a loading effect on the transmission path between the first signal terminal and the second signal terminal by adjusting at least one parameter of the connection unit;

wherein the first signal terminal is utilized for receiving a signal, and the second signal terminal is utilized for outputting a filtering result of the signal.

9. The broadband coupling filter of claim 8, wherein the at least one parameter of the connection unit is chosen from one of a length, a material, and components of the connection unit.

10. The broadband coupling filter of claim 8, wherein the connection unit and the second block transmission line are connected to the third signal terminal and the fourth signal terminal in parallel.

11. A broadband coupling filter, comprising:

a substrate, comprising a first layer, a second layer and a third layer, wherein the second layer is between the first layer and the third layer;

a first signal terminal, formed in the first layer of the substrate;

a second signal terminal, formed in the first layer of the substrate;

a third signal terminal, formed in the third layer of the substrate;

a fourth signal terminal, formed in the third layer of the substrate;

a grounding plate, formed in the second layer of the substrate, and having a hole;

a first block transmission line, formed at a position corresponding to the hole in the first layer of the substrate, and coupled to the first signal terminal and the second signal terminal;

a second block transmission line, formed at a position corresponding to the hole in the third layer of the substrate, and coupled to the third signal terminal and the fourth signal terminal, and having a shape identical to a shape of the first block transmission line; and a connection unit, formed in the third layer of the substrate, for connecting the third signal terminal and the fourth signal terminal, wherein the second block transmission line and the connection unit are connected in parallel between the third signal terminal and the fourth signal terminal;

wherein the first signal terminal is utilized for receiving a signal, and the second signal terminal is utilized for outputting a filtering result of the signal.

12. The broadband coupling filter of claim 11, wherein the connection unit and the second block transmission line form a closed loop.

* * * * *